US010472107B2

(12) United States Patent
Voss et al.

(10) Patent No.: US 10,472,107 B2
(45) Date of Patent: Nov. 12, 2019

(54) ADVANCING DEVICE FOR ADVANCING A FILM WEB IN A BAG FILLING INSTALLATION

(71) Applicants: Hans-Ludwig Voss, Tecklenburg (DE); Oliver Huil, Hörstel (DE); Ralf Udally, Bonn (DE); Thomas Hawighorst, Hasbergen (DE); Rüdiger Große-Heitmeyer, Westerkappeln (DE); Roman Smid, Olomouc (CZ)

(72) Inventors: Hans-Ludwig Voss, Tecklenburg (DE); Oliver Huil, Hörstel (DE); Ralf Udally, Bonn (DE); Thomas Hawighorst, Hasbergen (DE); Rüdiger Große-Heitmeyer, Westerkappeln (DE); Roman Smid, Olomouc (CZ)

(73) Assignee: WINDMÖLLER & HÖLSCHER KG, Lengerich (DE)

( * ) Notice: Subject to any disclaimer, the term of this patent is extended or adjusted under 35 U.S.C. 154(b) by 458 days.

(21) Appl. No.: 14/288,715

(22) Filed: May 28, 2014

(65) Prior Publication Data

US 2014/0352257 A1 Dec. 4, 2014

(30) Foreign Application Priority Data

May 29, 2013 (DE) ..... 10 2013 105 551

(51) Int. Cl.
*B65B 41/16* (2006.01)
*B65B 1/02* (2006.01)
(Continued)

(52) U.S. Cl.
CPC ..... *B65B 41/16* (2013.01); *B65B 1/02* (2013.01); *B65B 9/10* (2013.01); *B65H 23/1888* (2013.01);
(Continued)

(58) Field of Classification Search
CPC ..... B65B 9/10; B65B 41/16; B65B 43/04; B65B 5/06; B65B 57/02
(Continued)

(56) References Cited

U.S. PATENT DOCUMENTS 3,116,032 A 12/1963 Roberts
4,656,813 A * 4/1987 Baldini ..... B65B 55/02 53/133.1
(Continued)

FOREIGN PATENT DOCUMENTS

DE 3440441 C2 4/1990
DE 3933925 A1 5/1990
(Continued)

OTHER PUBLICATIONS

Office Action dated Dec. 5, 2013, issued by the German Patent Office in German Patent Application No. 102013105551.6 which is the corresponding patent application in Germany of the present application.
(Continued)

*Primary Examiner* — Alexander M Valvis
*Assistant Examiner* — Mary C Hibbert-Copeland
(74) *Attorney, Agent, or Firm* — Porzio Bromberg & Newman P.C.

(57) ABSTRACT

The invention relates to an advancing device (10) for advancing a film web (200) in a bag filling installation (100, having a main advancing drive (20) with at least one driven main advancing roller (22) for advancing the film web (200), wherein for an adjustment of the tensile stress of the film web (200) in the transport direction (T) of the film web (200) an auxiliary advancing drive (30) is disposed before the main advancing drive (20) with at least one driven auxiliary advancing roller (32) for advancing the film web (200).

12 Claims, 4 Drawing Sheets

Figure 1:
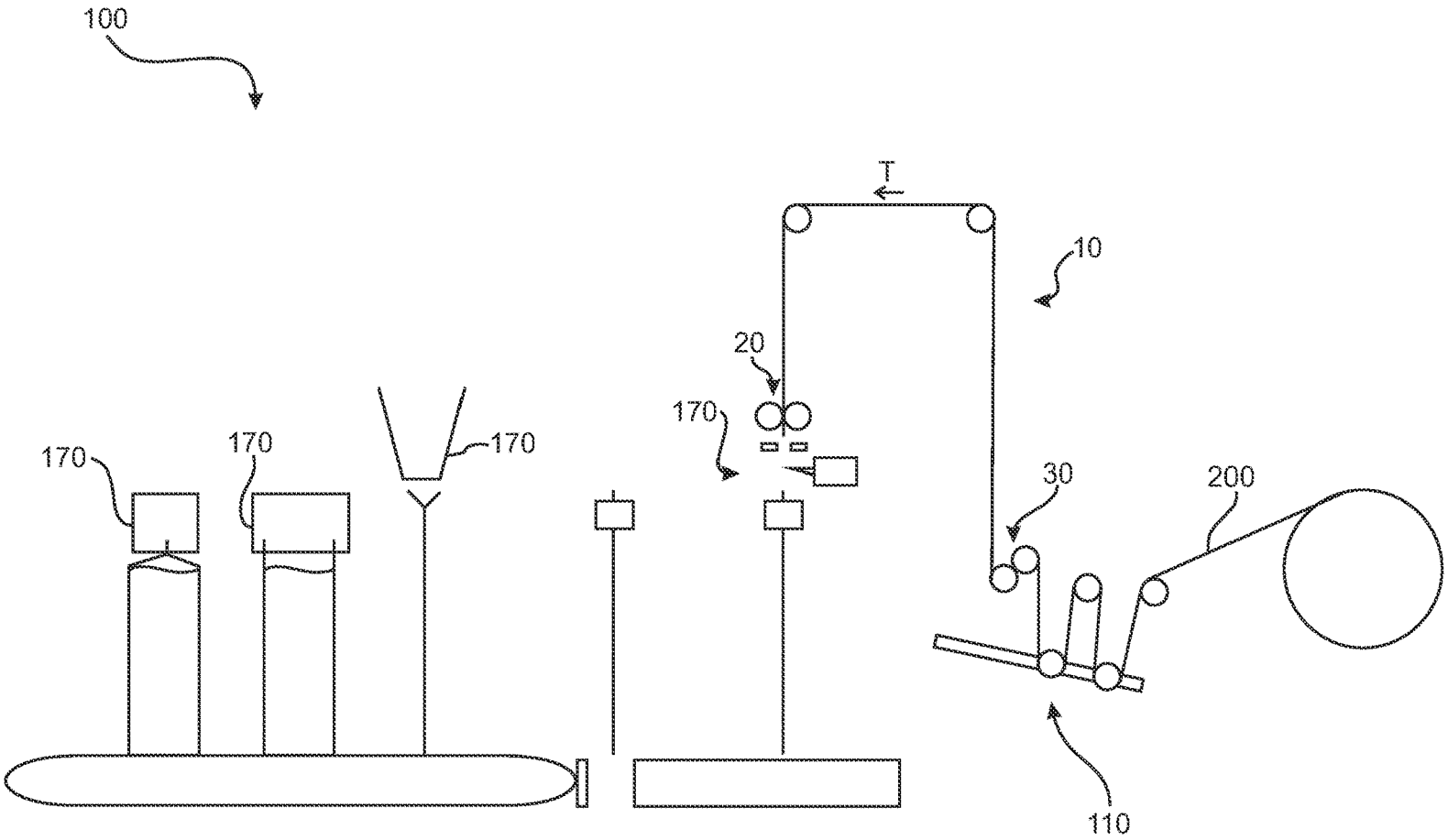

(51) Int. Cl.

| | |
|---|---|
| ***B65B 9/10*** | (2006.01) |
| ***B65H 23/188*** | (2006.01) |
| *B65B 43/46* | (2006.01) |
| *B65B 51/14* | (2006.01) |
| *B65B 51/26* | (2006.01) |
| *B65B 51/32* | (2006.01) |
| *B65B 61/06* | (2006.01) |

(52) U.S. Cl.
CPC ..... *B65B 43/465* (2013.01); *B65B 51/14* (2013.01); *B65B 51/26* (2013.01); *B65B 51/32* (2013.01); *B65B 61/06* (2013.01); *B65H 2403/55* (2013.01); *B65H 2404/143* (2013.01); *B65H 2701/1752* (2013.01)

(58) Field of Classification Search
USPC ..... 53/396, 450, 389.4, 545, 167, 64
See application file for complete search history.

(56) References Cited

U.S. PATENT DOCUMENTS 4,754,593 A * 7/1988 Ishihara ..... B65B 9/2028 53/51
6,247,293 B1 * 6/2001 Todd ..... B31B 19/00 53/329.2
2003/0115840 A1 * 6/2003 Frey ..... B65B 11/00 53/556
2006/0216414 A1 * 9/2006 Sakamoto ..... G02F 1/133 427/162
2012/0126445 A1 * 5/2012 Rasmussen ..... B29C 55/06 264/175

FOREIGN PATENT DOCUMENTS

| | | | |
|---|---|---|---|
| DE | 3031399 | C3 | 4/1993 |
| DE | 60222854 | T2 | 7/2008 |
| DE | 102011080462 | A1 | 2/2013 |
| EP | 0999134 | A2 | 5/2000 |
| FR | 2964375 | A1 | 3/2012 |

OTHER PUBLICATIONS

Office Action dated Apr. 14, 2016 issued by the German Patent Office in German Patent Application No. 102013105551.6, which is the corresponding patent application in Germany of the present application.
European Search Report issued by the European Patent Office in corresponding co-pending European Application No. 14166134.8-1708 dated Jul. 17, 2014.
European Office Action, EP14166134.8, dated Nov. 8 , 2016.

* cited by examiner

ADVANCING DEVICE FOR ADVANCING A FILM WEB IN A BAG FILLING INSTALLATION

The present invention relates to an advancing device for advancing a film web in a bag filling installation, a bag filling installation with such an advancing device and also a method for the adjustment of a tensile stress of a film web in a bag filling installation.

Bag filling installations and advancing devices for bag filling installations are known in principle. Thus for example bag filling installations are used for filling bags or bag sections of a film web with bulk material. For this purpose, starting from a continuous film web, e.g. a tubular film, conveying is frequently carried out through the bag filling installation. In this case it must be ensured that a transport force for the conveying is transmitted to the film web. For this purpose advancing devices are usually provided in the form of advancing drives. For example a main advancing roller is provided which, by appropriate pressure on the film web and corresponding frictional grip or frictional contact, transmits a transport force for advancing the film web thereon. As a result the sheet of film can be conveyed by this transmission of force through the bag filling installation.

However, a disadvantage in known bag filling installations is that usually a buffer device must be provided, in order to be able to switch over from continuous rolling of a supply roller to a cyclical or intermittent conveying to the individual filling stations of the bag filling installation. Such a buffer device is usually constructed as a dancer. However, since this dancer device is in reciprocating operation this leads to unwanted further conveying for a short period of time of the film web after the end of a conveying cycle in the clocked area of the bag filling installation. This further conveying, although the current end of the film web had already been stopped, leads to a reduction the tensile stress in the film web. In other words the film web in the region up to its end will be looser in the bag filling installation. In order to be able to carry out the following processing steps in corresponding stations, however, sufficient tensile stress is necessary. Accordingly in known bag filling installation after a conveying cycle has stopped it is necessary to wait until the pendulum motion of the buffer device has again been carried out in the other direction of movement to such an extent that the required tensile stress has been achieved again. In other words after each conveying cycle there is a short break, in which the entire machine must wait for the restoration of the tensile stress. This break extends the entire machine cycle, so that the bag filling installation can be operated with a lower production speed.

It is an object of the present invention at least partially to eliminate the aforementioned disadvantages of the prior art. In particular it is an object of the present invention that the cycle time of the installation can be reduced cost-effectively and simply, in particular a tensile stress can be established again as quickly as possible or kept constant in the film web.

The aforementioned object is achieved by an advancing device with the features of claim 1, a bag filling installation with the features of claim 9 and a method with the features of Claim 10. Further features and details of the invention are apparent from the subordinate claims, the description and the drawings. In this case features and details which are described in connection with the advancing device according to the invention also of course apply in connection with the bag filling installation according to the invention as well as the method according to the invention and in each case vice versa, so that with respect to the disclosure reference is or can be always made reciprocally to the individual aspects of the invention.

An advancing device according to the invention is designed to advance a film web in a bag filling installation. For this purpose the advancing device has a main advancing drive with at least one driven main advancing roller for advancing the film web. An advancing device according to the invention is characterised in that for an adjustment of the tensile stress of the film web in the transport direction of the film web an auxiliary advancing drive is disposed before the main advancing drive with at least one driven auxiliary advancing roller for advancing the film web.

A driven main advancing roller and a driven auxiliary advancing roller should be understood to be any form of application of a torque. Thus this also includes in particular a braking torque for the respective advancing roller.

In contrast to known advancing devices an advancing device according to the invention is characterised by two separate advancing drives, namely the main advancing drive and the auxiliary advancing drive. These are crucially spaced apart from one another spatially. Thus over the extent of the film web along the conveying direction in the bag filling installation, first the auxiliary advancing drive is disposed and only later the main advancing drive is disposed. In particular the main advancing drive is located at a position within the bag filling installation at which cutting to length and cutting into individual bag portions takes place. The auxiliary advancing drive is preferably in the vicinity of the dancer device, that is to say in particular directly after the dancer device or the buffer device. By this localised spacing a defined extent of the film web can be produced which always runs between the auxiliary advancing drive and the main advancing drive. With this arrangement the auxiliary advancing drive is disposed upstream of the main advancing drive upstream and simultaneously downstream of the buffer device. As a result overshooting or further conveying after stopping of the main advancing drive can preferably be avoided. Thus the auxiliary advancing drive can serve so to speak as a stop to prevent the film web from overshooting and penetrating into the region between the two advancing drives. Also by different controls a different advancing speed can be set for the two advancing drives. Due to speed differences in the advance of the two advancing drives a lead of the main advancing drive or a lag of the auxiliary advancing drive will be so to speak deliberately achieved, so that an explicit defined tensile stress can be introduced into the film web, and in particular can be kept constant.

An advancing drive should be understood in principle to be a main advancing roller and a corresponding driving device, for example an electric motor. In this case a common driving device can be provided for both advancing drives. It is also possible that each advancing drive has a discrete and accordingly separately controllable driving device. The two advancing drives are preferably coupled to one another in such a way that a speed difference or an exact speed correlation in the driving of the two advancing rollers of the main advancing drive and of the auxiliary advancing drive is adjustable.

An advancing device according to the invention is used in particular for a bag filling installation according to the so-called FFS (Form-Fill-Seal) method. Such a bag filling installation is based upon a supply roller which makes a film web, in particular a tubular film, available substantially with an endless structure. This film web extends into the bag filling installation and is continuously conveyed from the supply roller. A conversion of the continuous conveying operation into a cyclical feed takes place by means of a buffer device, which may be constructed as a dancer device. The auxiliary advancing drive is preferably already disposed following this buffer device. Then sealing devices for corner weld seams and corresponding cooling devices can be provided, so that at the end of the continuously extent of the film web a base sealing station can be provided for the production of a base sealing seam and the cutting to length to form individual bag.

Next by means of a reciprocating operation and gripper systems the bag portions are transported further to a filling station and also to a top sealing station and a cooling station for cooling of the top seal.

The transmission of the transport force from the respective advancing roller to the film web preferably takes place by means of a frictional contact or a frictional grip between the respective advancing roller and the film web. This frictional grip is reinforced by corresponding wrap angles, which are preferably in the region of approximately 180° or more. For this purpose a plurality of advancing rollers can also be provided, wherein one or more of these advancing rollers can be driven. A driven film roller and a freely rotatable advancing roller are preferably provided, between which a conveying gap is formed for conveying the film web. Depending upon the geometric arrangement relative to the film web, the most varied wrap angles of even more than 180° can also be achieved.

The two advancing drives are preferably drives which are synchronous in terms of time, which can be synchronised with the cycle of the machine. Thus the two advancing drives are preferably in operation for the same time periods and at a standstill for the same time periods. Accordingly if the main advancing roller of the main advancing drive stops, so also does the auxiliary advancing roller of the auxiliary advancing drive.

As has already been explained, the auxiliary advancing drive thus forms a safety device, so that further conveying is prevented as the reciprocating motion of the buffer device for the film web does not swing back into the section between the two advancing drives. The stations for processing of the film web, which are disposed downstream of the auxiliary advancing drive in the transport direction, can accordingly be operated immediately, so that no further waiting time is to be expected. By comparison with known advancing devices in known bag filling installations the machine cycle can be accelerated and thus a higher productivity of the bag filling installation can be achieved.

It may be advantageous if in an advancing device according to the invention the main advancing drive can be driven at a different advancing speed from the auxiliary advancing drive, in particular at a higher advancing speed than the auxiliary advancing drive. In other words, for the main advancing drive a lead relative to the auxiliary advancing drive is set for the auxiliary advancing drive a so-called lag in relation to the main advancing drive is set. Accordingly the main advancing drive conveys the film web more quickly than the auxiliary advancing drive. However, since the conveying distance between the main advancing drive and the auxiliary advancing drive is constant, a defined tensile stress is maintained in the film web due to the conveying speed difference between the two advancing drives. The greater the difference which is set between the two advancing speeds, the greater the tensile stress in this section between the two advancing drives will be. In this case the different advancing speeds can be set in the most varied ways. By way of example an electronic coupling can be provided which, in the case of different driving devices of the two advancing drives, controls them separately and at different advancing speeds. Also other forms of coupling, for example mechanical coupling devices, are conceivable within the scope of the present invention and will be explained in greater detail below. In this case the advancing speed is the speed which is preferably produced by the speed of rotation of the respective advancing roller. Accordingly a difference leads to different transport speeds for the film web on the respective advancing roller.

It may be advantageous if in an advancing device according to the invention the main advancing drive is coupled to the auxiliary advancing drive at least partially by means of a mechanical coupling device, which by means of a transmission predetermines the correlation of the advancing speeds of the two drive units. The expression "transmission" is deliberately intended to be understood in broad terms, so that already the correlation of a belt drive comprising two belt pulleys, wherein in each case a belt pulley is disposed on an advancing drive should be understood as a transmission. Thus according to the invention the transmission fulfils the function of a step-up gear or a reduction gear, in order to be able deliberately to ensure a speed correlation, in particular a speed difference between the two advancing drives. Of course, however, more complex transmissions, in particular with gears or pinions are conceivable within the scope of the present invention. A great advantage of the mechanical coupling device is the automatic synchronisation of the two advancing drives with one another. In particular a common driving device can be used for the two advancing drives, so that here too savings can be made on costs and complexity. Of course the mechanical coupling device, in particular the transmission, can have a variation option, so that for example with the aid of a variation device a change to the correlation of the advancing speeds of the two drives is possible.

Furthermore, it may be advantageous if in an advancing device according to the invention the main advancing drive is coupled to the auxiliary advancing drive at least partially by means of an electronic coupling device, which predetermines the correlation of the advancing speeds of the two drive units. Of course in principle coupling of a mechanical coupling device to an electronic coupling device is also conceivable. An electronic coupling device can be provided for example by a control device of a bag filling installation. Thus for example the main advancing drive is provided with a main advancing driving device, whilst the auxiliary advancing drive has an auxiliary advancing driving device. The respective driving device applies a rotational force to the respective advancing roller, so that a corresponding advancing speed is set for the respective advancing drive. This rotational speed is preferably controlled or regulated by a common control device, so that an explicit correlation of the respective rotational speeds relative to one another and thus a defined correlation of the advancing speeds of the two drives can be set. In addition to a mechanical coupling, such as has been explained in the preceding paragraph, a change to the correlation is also possible in this way particularly simply and especially also during the operation. In this case the main advancing unit is preferably set as master, whilst the auxiliary advancing unit with its drive is set up as slave to the master. Thus for example a defined lag can be set for generation of a required tensile stress value on the film web, so that the main advancing drive is only adjusted directly. Due to the slave connection the auxiliary advancing drive follows the main advancing drive automatically with a set and defined lag as lag value.

It is likewise advantageous if in an advancing device according to the invention the main advancing drive and the auxiliary advancing drive can be operated so that they are correlated with one another on a common cycle, in particular synchronously in a common cycle. This means that there is a correlation in particular with the machine cycle. Thus, as has already been indicated, operation of the main advancing drive and the auxiliary advancing drive is started at the same time and stopped again at the same time. In particular a completely synchronised mode of operation of the two advancing drives takes place. By selection of a mechanical coupling, as has been explained, these synchronisation is produced virtually automatically.

It is likewise advantageous if in an advancing device according to the invention the main advancing drive and/or the auxiliary advancing drive have at least one freely rotatable film roller. In correlation with the driven advancing roller this film roller can have a common conveying gap with the advancing roller for passage and thus transport of the film web. Thus the defined conveying gap also leads in particular to a sufficient contact pressure of the driven advancing roller on the film web. In this case a freely rotatable film roller should be understood as a film roller without a dedicated drive. By this improved guiding of the film web is achieved with an explicit conveying gap. Also for example a spring device can press this freely rotatable film roller onto the film web with a defined pressing force.

In an advancing device according to the preceding paragraph it may be advantageous if the freely rotatable film roller is disposed in such a way that an S-shaped loop of the film web forms between the freely rotatable film roller and the auxiliary advancing roller and/or the main advancing roller. Thus the correlation leads to a relatively long conveying path along the transport direction of the film web. In particular an S-shaped loop is achieved which in total enables a looping angle of more than 180° for the film roller and the advancing roller. The greater the looping angle is, the greater the friction surface will also be, so that the transmission of the transport forces is improved. In particular at high transport speeds or at high transport forces or required high tensile stress values, in this way a higher abutment force is ensured between the two advancing drives.

It is likewise advantageous if in an advancing device according to the invention the main advancing drive and/or the auxiliary advancing drive have a pressing device for generating a pressing force between the film web and the main advancing roller and/or the auxiliary advancing roller. This pressing device is for example formed by a freely rotatable film roller which is subjected to a spring force by a spring device. In particular in this way a further improvement to the transport force is possible by an increase in the frictional grip on the film web.

The invention also relates to a bag filling installation, in particular a Form-Fill-Seal installation, for filling bags with bulk material, having an advancing device for advancing a film web. A bag filling installation according to the invention is characterised in that the advancing device is constructed in the manner according to the invention. Therefore a bag filling installation according to the invention provides the same advantages as those which have been explained in detail with respect to an advancing device according to the invention.

The present invention also relates to a method for the adjustment of a tensile stress of a film web in a bag filling installation, in particular according to the present invention, having the following steps:

predetermination of a tensile stress for the tensile stress on the film web, correlated, in particular synchronous, advancing of the film web with a main advancing drive and an auxiliary advancing drive disposed in the transport direction of the film web before the main advancing drive while maintaining the predetermined tensile stress value.

By the use of an advancing device which in particular is constructed in the manner according to the invention the same advantages are achieved for the method as those which have been explained in detail with respect to an advancing device according to the invention. In particular in a defined manner a correlation of the advancing speeds for the main advancing drive and the auxiliary advancing drive can be ensures, so that as a result for example a defined lag can be generated. Thus for example by the mechanical and/or electronic coupling of the advancing drives, a defined tensile stress situation for the film web can be set and kept constant.

Figure 2:
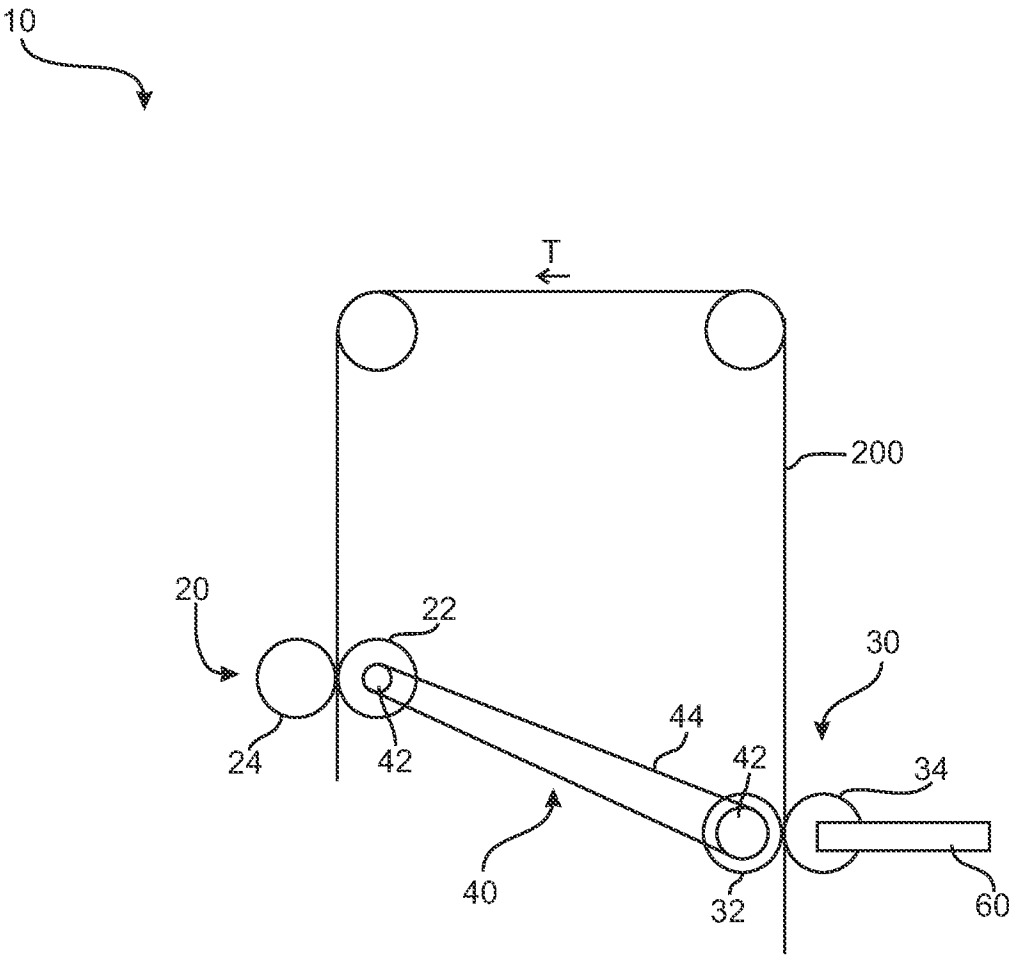
Figure 3:
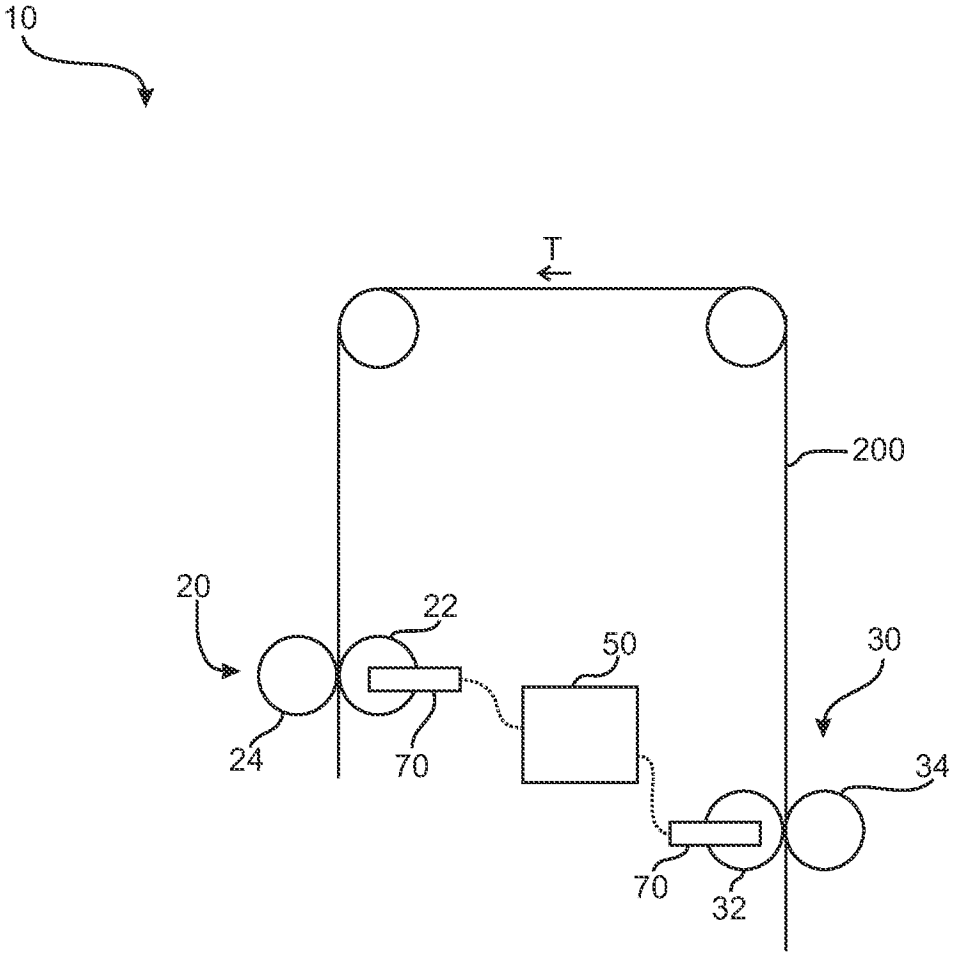
Figure 4:
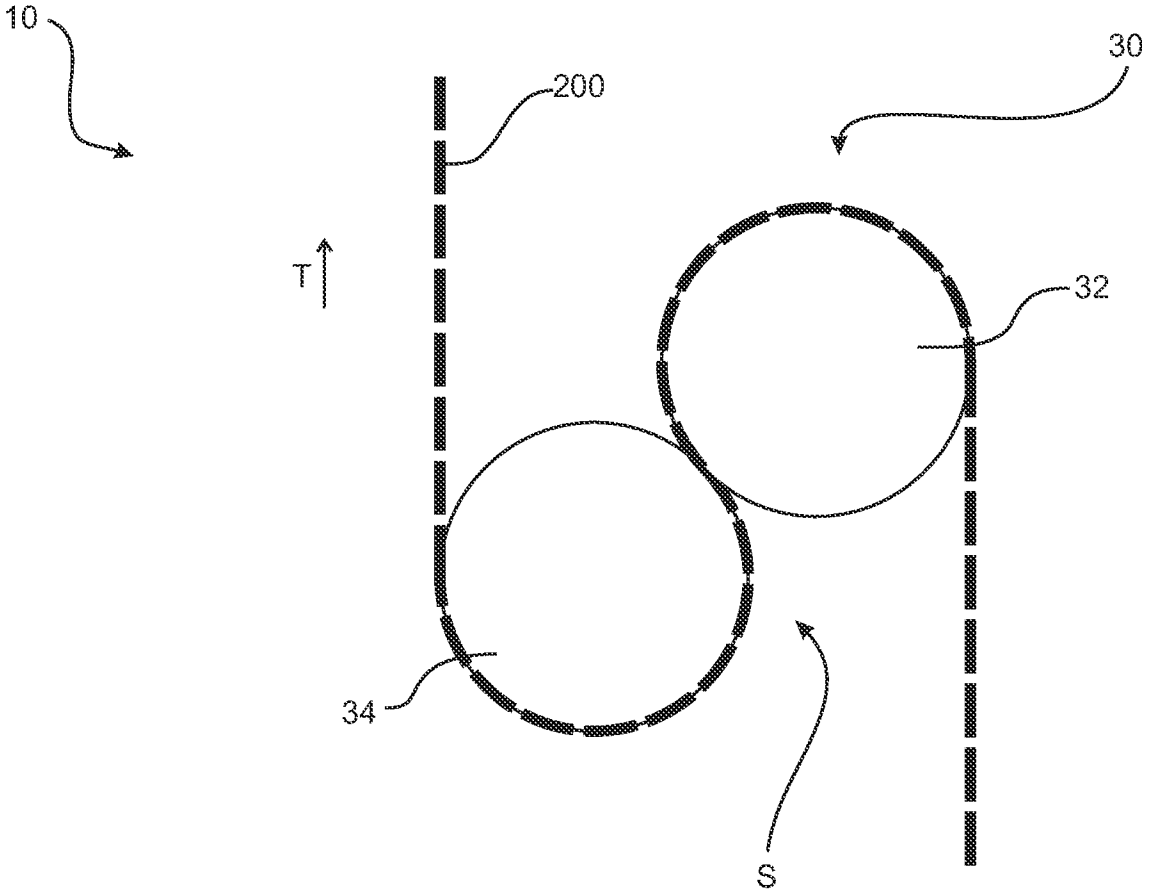

Further advantages, features and details of the invention are apparent from the following description in which embodiments of the invention are described in detail with reference to the drawings. In this case the features mentioned the claims and in the description may in each case be essential to the invention individually or in any combination. In the drawings, in each case schematically:

FIG. 1 shows a representation of a bag filling installation according to the invention, FIG. 2 shows an embodiment of an advancing device according to the invention, FIG. 3 shows a further embodiment of an advancing device according to the invention, and FIG. 4 shows a further embodiment of an auxiliary advancing drive according to the invention.

A bag filling installation 100 according to the invention is illustrated schematically in FIG. 1. The start of the process takes place to the right of a supply roller, from which a film web 200 is continuously unwound. By means of a buffer device 110, which is designed in reciprocating operation as a dancer device, the continuous operation of conveying the film web 200 is converted into a subsequent cycling of the operation of conveying the film web 200.

An advancing device 10 according to the invention is disposed starting from the buffer device 110. Thus an auxiliary advancing drive 30, by means of which a main advancing drive 20 is reached via different guide rollers by the film web 200, is disposed directly downstream of the buffer device 110. The following station 170 is the base seam sealing station and the cutting device for cutting to length of individual bag portions. By means of gripping devices operated in reciprocating motion the bag portions are transported further towards the left to the next station 170, which has a schematically illustrated filling hopper. In the next station 170 to the left the filled bag portion is provided with a top seam which is cooled in the last, leftmost station 170.

In FIG. 1 it can be readily seen that without the auxiliary advancing drive 30 from the film web 200 the continuous conveying exclusively by the buffer device 110 is converted into the cyclical feed the sheet of the film web 200. If the transport of the main advancing drive 20 stops, then further swinging or further conveying of the film web 200 takes place over a short time period and thus a reduction in the tensile stress on the film web 200 takes place in the region of the main advancing drive 20. In the past the buffer device 110 had first to begin again, to swing the reciprocating operation back, in order to re-establish the required tensile stress. According to the invention the auxiliary advancing drive 30 blocks this described effect of the further swinging or further conveying of the film web 200. By correlation of the advancing speeds of the two advancing drives 20 and 30 a defined tensile stress can be set to be substantially constant for all usage situations (stationary and driven).

A further embodiment of an advancing device 10 according to the invention is shown schematically in FIG. 2. Here, moreover, the auxiliary advancing drive 30 is provided with a pressing device 60 which exerts a spring force on a freely rotatable film roller 34. In addition to the main advancing roller 22, the main advancing drive 20 is also provided with a freely rotatable film roller 24. In this case it is sufficient if one of the two advancing rollers 22 or 32 has an active driving device (not shown). The two advancing rollers 22 and 32 have a mechanical coupling device 40 which here has a belt 44 as belt drive. By means of two belt pulleys in each case a transmission 42 is formed on the respective advancing roller 22 and 32, in order to be able to ensure a synchronously cyclical implementation of the two advancing drives 20 and 30. At the same time there is a reduction gear or a step-up gear, so that a defined lag for the auxiliary advancing drive 30 is ensured relative to the main advancing drive 20. This leads to an explicit adjustment of the tensile stress in the film web 200 over the run along the transport direction T.

FIG. 3 shows an embodiment of an advancing device 10 according to the invention. This is in principle configured similarly to the embodiment of FIG. 2, but here an electronic coupling device 50 is provided. As the dotted lines show, this is connected in a signal-communicating manner to two driving devices as motor 70 of the two advancing roller 22 and 32. Thus a setting of the respective advancing speed can be carried out here explicitly and substantially electronically, preferably digitally. Thus even during operation a variation in the difference between the advancing speeds and thus a variation in the tensile stress in the film web 200 is possible.

FIG. 4 shows on an enlarged scale a particularly advantageous embodiment of an auxiliary advancing drive 30. Here the advancing roller 32 and the freely rotatable film roller 34 are constructed relative to one another in such a way that an S-shaped loop S forms along the transport direction T for the film web 200. The total looping angle of the film web 200 within the auxiliary advancing drive 30 is brought here to more than approximately 180°. Thus a particularly strong abutment is made available, so that even at high transport speeds, at high transport forces and/or at high tensile stresses a sufficient abutment can be provided between the two advancing drives 20 and 30.

The preceding explanation of the embodiments describes the present invention exclusively in the context of examples. Of course individual features of the embodiments can be freely combined with one another, if technically practical, without departing from the scope of the present invention.

LIST OF REFERENCE SIGNS

10 advancing device
20 main advancing drive
22 main advancing roller
24 freely rotatable film roller
30 auxiliary advancing drive
32 auxiliary advancing roller
34 freely rotatable film roller
40 mechanical coupling device
42 transmission
44 belt
50 electronic coupling device
60 pressing device
70 motor
100 bag filling installation
110 buffer device
170 station
200 film web
S S-shaped loop
T transport direction

The invention claimed is:

1. A advancing device in a bag filling installation for advancing a film web, comprising a main advancing drive with at least one driven main advancing roller for advancing the film web, wherein for an adjustment of the tensile stress of the film web in the transport direction (T) of the film web an auxiliary advancing drive is disposed before the main advancing drive and spaced apart from the main advancing drive, the auxiliary advancing drive having at least one driven auxiliary advancing roller for advancing the film web, wherein at least one of the main advancing drive or the auxiliary advancing drive have at least one freely rotatable film roller and wherein the freely rotatable film roller is disposed in such a way that an S-shaped loop (S) of the film web forms along the transport direction (T) of the film web between the freely rotatable film roller and the auxiliary advancing roller and/or between the freely rotatable film roller and the main advancing roller wherein the S-shaped loop (S) of the film web is in abutment with the freely rotatable film roller and the auxiliary advancing roller and/or with the freely rotatable film roller and the main advancing roller wherein a total looping angle of the film web for the auxiliary advancing roller and/or for the main advancing roller arid/or for the freely rotatable film roller at least 180°, wherein an electronic coupling device is connected in a signal communicating manner to the auxiliary advancing drive of the auxiliary advancing roller and the main advancing drive of the main advancing roller for a setting of a respective advancing speed to be carried out electronically.

2. The advancing device according to claim 1, wherein the main advancing drive is driven at a different advancing speed from the auxiliary advancing drive.

3. The advancing device of claim 2 wherein the main advancing drive is driven at a higher advancing speed than the auxiliary advancing drive.

4. The advancing device according to claim 1, wherein the main advancing drive and the auxiliary advancing drive are operated so that they are correlated with one another on a common cycle.

5. The advancing device of claim 4 wherein the main advancing drive and the auxiliary advancing drive are operated so that they are correlated with one another synchronously in the common cycle.

6. The advancing device according to claim 1, wherein the main advancing drive and/or the auxiliary advancing drive have a pressing device for generating a pressing force between the film web and the main advancing roller and/or the auxiliary advancing roller.

7. A bag filling installation for filling bags with bulk material, having an advancing device for advancing a film web, wherein the advancing device has the features of claim 1.

8. A method for the adjustment of a tensile stress of a film web in a bag filling installation, with the advancing device of claim 1, comprising the following steps:

predetermination of a tensile stress for the tensile stress on the film web, synchronous, advancing of the film web correlated with a main advancing drive and an auxiliary advancing drive disposed in the transport direction (T) of the film web before the main advancing drive while maintaining the predetermined tensile stress value.

9. The advancing device according to claim 1 wherein a total looping angle of the film web for each S-shaped loop (S) at least 180° which provides an abutment between the main advancing drive and the auxiliary advancing drive.

10. The advancing device according to claim 1 wherein each of the main advancing drive and the auxiliary advancing drive have the freely rotatable film roller and wherein at least one of the freely rotatable film rollers is disposed in such a way that the S-shaped loop (S) of the film web forms along the transport direction (T) of the film web between the freely rotatable film roller and the auxiliary advancing roller and/or between the freely rotatable film roller and the main advancing roller.

11. The advancing device according to claim 1 wherein the electronic coupling device is configured as a control device.

12. An advancing device in a bag filling installation for advancing a film web comprising a main advancing drive with at least one driven main advancing roller for advancing the film web, wherein for an adjustment of the tensile stress of the film web in the transport direction (T) of the film web an auxiliary advancing drive is disposed before the main advancing drive and spaced apart from the main advancing drive, the auxiliary advancing drive having at least one driven auxiliary advancing roller for advancing the film web, wherein at least one of the main advancing drive or the auxiliary advancing drive have at least one freely rotatable film roller and wherein the auxiliary advancing drive is disposed upstream of the main advancing drive and simultaneously downstream of a buffer device and, wherein the freely rotatable film roller is disposed in such a way that an S-shaped loop (S) of the film web forms along the transport direction (T) of the film web between the freely rotatable film roller and the auxiliary advancing roller and/or between the freely rotatable film roller and the main advancing roller, wherein the S-shaped loop (S) of the film web is in abutment with the freely rotatable film roller and the auxiliary advancing roller and/or with the freely rotatable film roller and the main advancing roller, wherein a total looping angle of the film web is at least 180°, wherein an electronic coupling device is connected in a signal communicating manner to the auxiliary advancing drive of the auxiliary advancing roller and the main advancing drive of the main advancing roller for a setting of a respective advancing speed to be carried out electronically.

* * * * *